US008331648B2

(12) United States Patent
Keeven et al.

(10) Patent No.: US 8,331,648 B2
(45) Date of Patent: Dec. 11, 2012

(54) MAKING SEALANT CONTAINING TWIST-ON WIRE CONNECTORS

(75) Inventors: James C. Keeven, O'Fallon, MO (US); Lloyd Herbert King, Jr., Chesterfield, MO (US)

(73) Assignee: Patent Store LLC, O'Fallon, MO (US)

( * ) Notice: Subject to any disclaimer, the term of this patent is extended or adjusted under 35 U.S.C. 154(b) by 631 days.

(21) Appl. No.: 12/286,975

(22) Filed: Oct. 3, 2008

(65) Prior Publication Data

US 2010/0086193 A1 Apr. 8, 2010

(51) Int. Cl.
*G06K 9/00* (2006.01)

(52) U.S. Cl. ..... 382/149; 356/237.1; 356/237.5

(58) Field of Classification Search ..... 382/141, 382/149; 356/237.1–237.5
See application file for complete search history.

(56) References Cited

U.S. PATENT DOCUMENTS

| | | | | |
|---|---|---|---|---|
| 4,790,023 | A * | 12/1988 | Matsui et al. | 382/149 |
| 5,151,239 | A * | 9/1992 | King, Jr. | 264/272.11 |
| 5,771,578 | A * | 6/1998 | King et al. | 29/885 |
| 6,314,199 | B1 * | 11/2001 | Hofer et al. | 382/141 |
| 6,317,205 | B1 * | 11/2001 | Merklein | 356/239.2 |
| 6,467,670 | B2 * | 10/2002 | Higashi et al. | 228/1.1 |
| 7,142,294 | B2 * | 11/2006 | Shibata et al. | 356/237.2 |
| 2005/0282428 | A1 * | 12/2005 | King, Jr. | 439/415 |
| 2007/0084620 | A1 * | 4/2007 | King et al. | 174/87 |
| 2010/0064513 | A1 * | 3/2010 | King et al. | 29/885 |

* cited by examiner

*Primary Examiner* — Tarifur Chowdhury
*Assistant Examiner* — Isiaka Akanbi
(74) *Attorney, Agent, or Firm* — Jacobson & Johnson LLC

(57) ABSTRACT

A system and a method of identifying, accepting or rejecting faulty sealant containing twist-on wire connectors wherein an image sensor generates an output image signal of a partly assembled twist-on wire connector or an assembled twist-on wire connector and compares the output image signal to a reference image signal to identify or reject a twist-on wire connector if the output image signal of the twist-on wire connector is outside an acceptable range and accept the twist-on wire connector if the output image signal is within the acceptable range.

16 Claims, 2 Drawing Sheets

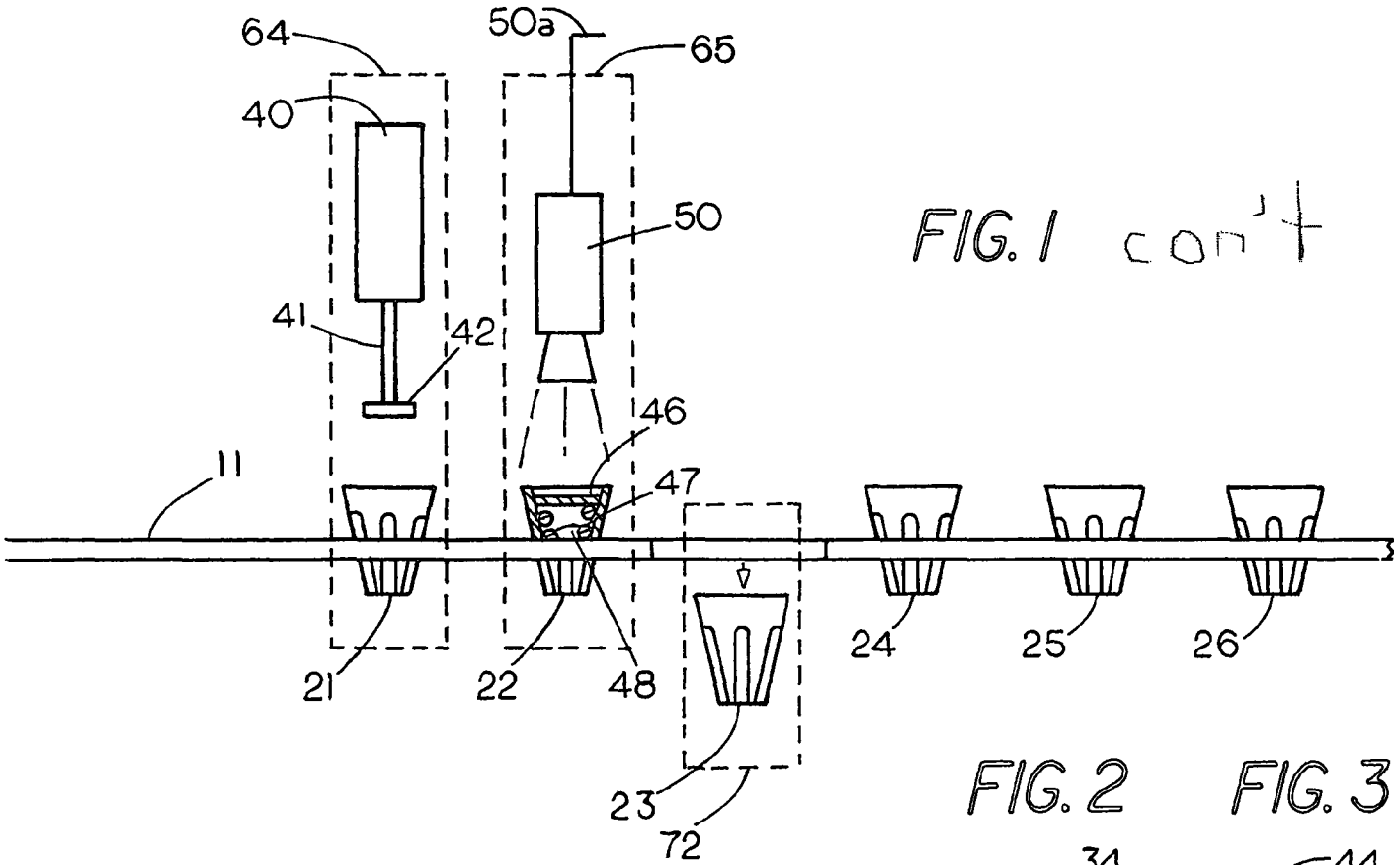
FIG. 1 cont
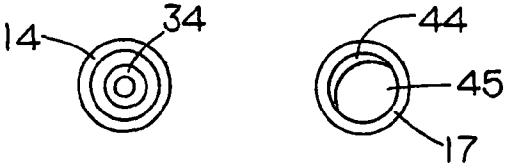
FIG. 2
FIG. 3
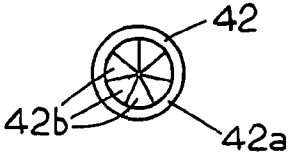
FIG. 4

MAKING SEALANT CONTAINING TWIST-ON WIRE CONNECTORS

FIELD OF THE INVENTION

This invention relates generally to twist-on wire connectors and, more specifically, to improvements to systems and method of making sealant containing twist-on wire connectors.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

An automated method and apparatus for making sealant containing twist-on wire connectors from basic components is shown in U.S. Pat. No. 5,771,578. The apparatus through use of numerous sensors addresses one of the difficulties in making twist-on wire connectors, which is to ensure that the sealant containing twist-on wire connectors are properly assembled. Typically, the components such as the shell and coil need to be assembled before a sealant can be injected into the coil. Occasionally, the coil or the sealant may not be properly assembled or the coil or the shell may not have been properly formed. In either case the result can be a faulty product. In order to minimize faulty products the U.S. Pat. No. 5,771,578 discloses an automated system that uses a number of optical sensors to detect the presence of components for assembly. A first sensor detects if the shells are being properly fed into the peripheral slots of a rotating table. A second sensor detects if the coils are being properly fed to a rotating assembly table. A third sensor determines if the coil is properly positioned in the shell and a fourth optical sensors determines if the caps are in position. Further optical sensors are used to determine if the coil is properly positioned in the shell. If the optical sensors detect that one or more of the twist-on wire connector components is not present on the assembly table or if the twist-on wire connector does not contain the proper amount of sealant the twist-on wire connector is rejected and is sent to a recycle bin.

One of the difficulties in the use of optical sensors in the manufacture of twist-on wire connectors containing a sealant is that the optical sensor may not work properly if the color of a twist-on wire connector changes. Other times surface reflection may confuse the optical sensor. Consequently, the systems with optical sensors may have unnecessary rejects. The present method minimizes the number of unnecessary rejects.

SUMMARY OF THE INVENTION

A system and a method of identifying, accepting or rejecting faulty sealant containing twist-on wire connectors wherein an image sensor generates an output image signal of a partly assembled twist-on wire connector or an assembled twist-on wire connector and compares the output image signal to a reference image signal to reject a twist-on wire connector if the output image signal of the twist-on wire connector is outside an acceptable range and accept the twist-on wire connector if the output image signal is within the acceptable range. In an alternate method the image sensors can identify faulty assembled connectors or different twist-on connectors for future diversion from an assembly line.

BRIEF DESCRIPTION OF THE DRAWINGS

FIG. 2 is a top view of twist-on wire connector with a spiral coil;

FIG. 3 is a top view of twist-on wire connector with a sealant located in the spiral coil; and FIG. 4 is a top view of an end cap for assembling to a twist-on wire connector.

DESCRIPTION OF THE PREFERRED EMBODIMENT

Figure 1:
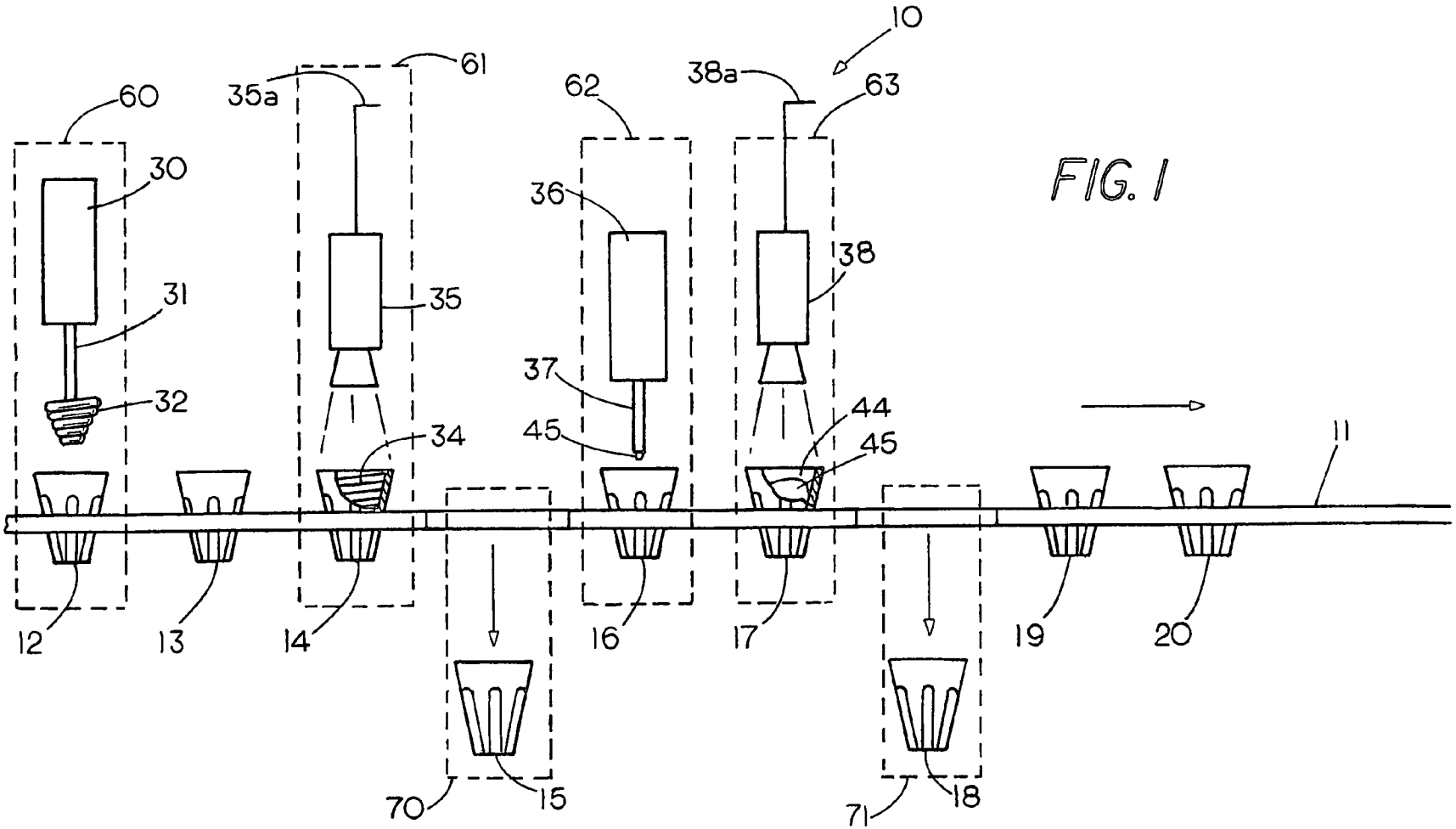
FIG. 1 is a front view of a system for assembling, accepting or rejecting a twist-on wire connector.

FIG. 1 shows an example of a system 10 for the manufacture of a sealant containing twist-on wire connector wherein twist-on wire connectors that are either partly assembled or completely assembled can either be identified, accepted or rejected through use of image sensors. Image sensors are known in the art and are commercially available from companies such as Micron Technology, Inc. of Boise Id. System 10 includes a twist-on wire connector conveyor 11 for transporting twist-on wire connectors from left to right as indicated by the horizontal arrow. Conveyor 11 extends through multiple stations 60, 61, 62, 63, 64, 65, 70, 71 and 72 to carry twist-on wire connectors 12-26 in an upright condition from station to station. While an elongated conveyer 11 is shown other types of systems for transporting the twist-on wire connectors between stations may be used for example, rotating tables can be used to transport the twist-on wire connectors from station to station. Alternately, the twist-on wire connectors may remain stationary and the stations moved with respect to the twist-on wire connectors. In the system 10 one can view the twist-on wire connectors by intermittently starting and stopping conveyor line 11 to view a coil in the twist-on wire connector with the image sensor.

System 10 includes three types of stations, a set of twist-on wire connector assembly stations 60, 62 and 64 for formation of sealant containing twist-on wire connectors, a set of imaging stations 61, 63 and 65 having image sensors for generating images of twist-on wire connectors as well as identifying faulty twist-on wire connectors and a set of rejection stations 70, 71, and 72 for removing faulty twist-on wire connectors from the assembly line. In the coil insertion station 60 the twist-on wire connector receives a spiral coil and in the assembly station 62 a sealant is injected into the cavity or pocket in the spiral coil in the twist-on wire connector. In assembly station 64 an end cap is placed on the open end of the twist-on wire connector. In each of the image stations an image of a twist-on wire connector in either an assembled condition or partly assembled condition can be compared to a reference image to determine if the twist-on wire connector is faulty. If faulty, the rejection stations can remove faulty twist-on wire connectors from the conveyor line. In the embodiment shown each of the image sensors therein are positioned to generate an image of an open end of an upright twist-on wire connector.

A reference to FIG. 1 shows that in the first assembly station 60 a coil 32 is mechanically inserted into an open end of a twist-on wire connector 12 while the twist-on wire connector is supported by conveyor 11. Coil 32, which has a spiral or tapered configuration, is typically formed by bending a wire into a coil although other methods as well as materials may be used to form the coil for the twist-on wire connector. If wire is used to form the coil 32, preferably square wire is used in the coil formation since the corners of the square wire form threads for engaging the electrical wires that are ultimately joined in the twist-on wire connector. As used herein the term coil refers to the wire-engaging member that is normally found in twist-on wire connectors where a wire connection is formed by twisting the wires with respect to the twist-on wire connector. An example of the mechanically insertion of coils into a shell can be found in U.S. Pat. No. 5,771,578. In operation a coil applicator 30 extends arm and spiral coil 32 vertically downward thereon until the spiral coil 32 is positioned and locked in the pocket of twist-on wire connector 12. While station 60 shows a mechanical process for inserting the wire coil 32 in the twist-on wire connector 12 it is envisioned that other methods of placing the coil into a twist-on wire connector could be used, for example molding a shell of a twist-on wire connector around the spiral coil.

Located proximate to twist-on wire connector 12 on conveyor 11 is a twist-on wire connector 13 which has received a spiral coil in station 60. Twist-on wire connector 13 may or may not been properly assembled. To determine if a twist-on wire connector is or is not properly assembled one needs to identify any faulty twist-on wire connectors. Once the faulty twist-on wire connectors are identify one can then remove the faulty twist-on wire connectors from the system.

To identify if a coil has been properly inserted into a twist-on wire connector the present invention uses an image sensor that generates an image of the twist-on wire connector as it passes through image station 61. The twist-on wire connector 14 in image station 61 is shown partially in section to reveal the wire coil 34 that has been mechanically inserted in twist-on wire connector 14 in station 60. A top view of wire connector 14 with coil 34 therein is shown in FIG. 2. Positioned vertically above twist-on wire connector 14 is an image sensor 35 that generates a top end image of twist-on wire connector 14 and coil 34. The image sensor 35 generates an on-the-go image output signal of the top end of twist-on wire connector 14 and coil 34 which is compared to a reference signal of a top end image of a twist-on wire connector with a properly positioned spiral coil therein to determine if the image output signal of the twist-on wire connector with coil 34 is within an acceptable range, which may be initially determined by trial and error. That is, if the image output signal from image sensor 35 is within an acceptable range the twist-on wire connector 34 is allowed to move to the next station, however, if the image output signal of the coil containing twist-on wire connector 34 is outside the acceptable range a signal is sent from image sensor 35 through lead 35*a* to rejection station 70 that rejects the twist-on wire connector from the assembly line. The rejection of a twist-on wire connector from the assembly line, because the image output signal, which is outside the acceptable range, is illustrated in rejection station 70 which allows faulty twist-on wire connector 15 to fall from conveyor 11. Rejection stations may take a variety of forms, for example, the portion of the conveyor 11 around faulty twist-on wire connector 15 may temporarily separate to allow the faulty twist-on wire connector to fall from the conveyor 11 or an arm may be used to remove the faulty twist-on wire connector 15 from the conveyor line 11.

Image station 61 has the advantage of also providing monitoring information which may not obtainable with conventional sensors. For example, the system 10 may be used to assemble twist-on wire connectors in different colors. That is, during the manufacture of twist-on wire connectors a set of blue colored wire connectors may be followed by a set of red colored wire connectors. Use of image sensors, which are capable of determining a change in the color of the twist-on wire connectors, provide an advantage over optical sensors since optical sensors may require adjustment if the color of the twist-on wire connector changes to avoid improper rejection of twist-on wire connectors. The ability of the image sensors to account for changes in color can assist in minimizing improper rejections of twist-on wire connectors. A further advantage is that the image sensors can monitor physical characteristics of the twist-on wire connectors such as the size or shape of the twist-on wire connector that is being assembled. Another advantage in use of image sensors as opposed to optical sensors is image sensor can better adjust to changes in light reflection. A further advantage of the use of image sensor as opposed to optical sensors is that information such as the position or orientation of the spiral coil in the wire connector can be monitored to determine not only if the spiral coil is present but whether it is in the proper position in the twist-on wire connector and thus one can more accurately determine whether a twist-on wire connector is or is not faulty.

Next to rejection station 15 is an injection station 62 where a sealant 45 is injected into a twist-on wire connector 16 through a tube 37 connected to sealant source 36. The injection process is preferably automatic, however, manual insertion of sealant can also be performed. Once the sealant is injected into wire connector 16 the conveyor 11 caries wire connector to the image station 63.

FIG. 1 shows image station 63 having an image sensor 38 which is positioned vertically above the open top end of a twist-on wire connector 17 held in an upright condition. Twist-on wire connector 17 is shown partially in section to reveal the spiral coil 44 and the sealant 45 which is located in a cavity in the spiral coil 44. A top view of twist-on wire connector 17 with coil 44 and sealant 45 therein is shown in FIG. 3. Image sensor 38 generates an image output signal of twist-on wire connector 17, coil 34 and sealant 45 and compares the image output signal to a reference signal of a properly assembled twist-on wire connector, coil and a sealant to determine if the image output signal of twist-on wire connector 17 is within an acceptable range, which may be initially determined by trial and error. If the image output signal from image sensor 38 is within an acceptable range the twist-on wire connector 17 is allowed to move along conveyor line 11, however, if the image output signal of the twist-on wire connector 17 is outside the acceptable range a signal is sent through lead 38*a* to rejection station 71 that removes the twist-on wire connector 17 from the assembly line when the twist-on wire connector reaches station 71. The rejection of a twist-on wire connector from the assembly line 11, because the image output signal is outside the acceptable range is illustrated by twist-on wire connector 18 which is shown falling from conveyor 11 in rejection station 71.

FIG. 1 shows that properly assembled twist-on wire connectors 19 and 20 continue moving along conveyor 11 toward a capping station 64. Capping station 64 includes an actuator 41 that engages an end cap 42 for insertion on the open end of the wire connector 21. End cap 42 is shown in top view in FIG. 4 and includes an annular rim 42*a* with a set of flexible flaps 42*b* extending radial inward to permit the insertion of electrical wires therein. Once cap 42 is applied to the connector 21 the twist-on wire connector moves to the imaging station 65.

Located in imaging station 65 is an image sensor 50 and a twist-on wire connector 22, which is partially in section to reveal the end cap 46, the coil 47 and the sealant 48. Image sensor 50 generates an image output signal of twist-on wire connector 22, coil 47 and sealant 48 and compares the image output signal to a reference output signal of a properly assembled coil containing twist-on wire connector with a sealant therein to determine if the image output signal of twist-on wire connector 22 is within an acceptable range, which may set or determined by trial and error. If the image output signal from image sensor 50 is within an acceptable range the twist-on wire connector 48 is allowed to move along conveyor line 11, however, if the image output signal of the twist-on wire connector 48 is outside an acceptable range a signal is sent through lead 50*a* to a rejection station 72. The rejection of a twist-on wire connector 23 from the assembly line, because the image output signal is outside the acceptable range is illustrated by twist-on wire connector 23, which is in the process of falling from the assembly line 11.

The twist-on wire connectors 24, 25 and 26, which have been properly assembled and injected with sealant are allowed to continue along conveyor 11 where they can be prepared for shipment to a customer.

In the above-described example, the system for manufacture of a sealant containing twist-on wire connector includes rejection stations which are located after each of the image stations, however, other types of systems may be used. For example, a system for manufacture of a sealant containing twist-on wire connector that use a single rejection station. In such types of systems the information on a faulty assembled twist-on wire connector can be stored in a server until the faulty twist-on reaches a rejection station which is located after the assembly steps have been completed. Although three image stations are shown more or less image stations may be used depending on the information required and in some cases only a single image station may be used. For example, in twist-on wire connectors without end caps a single image station, such as image station 63 may be used to determine if the coil has been properly inserted as well as if the sealant has been properly injected into the twist-on wire connector.

We claim:

1. A system for the manufacture of a twist-on wire connector containing a sealant comprising:

a sealant injection station for injecting a sealant into a twist-on wire connector;

an image station for generating a reference image output signal;

a first image sensor for generating a sealant image output signal of an open end and an interior of the twist-on wire connector after the sealant is injected into the twist-on wire connector, said system comparing said sealant image output signal to the reference image output signal;

a first rejection station for rejecting the twist-on wire connector, said first rejection station removing a faulty twist-on wire connector from an assembly line if the sealant image output signal is outside an acceptable range; and a conveyor for carrying the twist-on wire connector to a next station if the sealant image output signal is within the acceptable range.

2. The system of claim 1 including a coil insertion station for inserting a coil into the twist-on wire connector;

a second image station for generating a second reference image output signal;

a second image sensor for generating a second image output signal of the interior of the twist-on wire connector after the coil is inserted into the twist-on wire connector, said system comparing said second image output signal to the second reference image output signal; and a second rejection station for rejecting the twist-on wire connector, said second rejection station removing the faulty twist-on wire connector from the assembly line if the second image output signal is outside a second acceptable range, said conveyor carrying the twist-on wire connector to a next station if the second image output signal is within the second acceptable range.

3. The system of claim 2 including an end cap station for placing an end cap onto the twist-on wire connector;

a third image station for generating a third reference image output signal;

a third image sensor for generating a third image output signal of the interior of the twist-on wire connector after the end cap is placed on the twist-on wire connector, said system comparing said third image output signal to the third reference image output signal; and a third rejection station for rejecting the twist-on wire connector, said third rejection station removing the faulty twist-on wire connector from the assembly line if the third image output signal is outside a third acceptable range, said conveyor carrying the twist-on wire connector to a next station if the third image output signal is within the third acceptable range.

4. The system of claim 1 including an end cap station for placing an end cap into the twist-on wire connector;

a further image station for generating a further reference image output signal;

a further image sensor for generating a further image output signal of the interior of the twist-on wire connector after the end cap is placed onto the twist-on wire connector, said system comparing said further image output signal to the further reference image output signal; and a further rejection station for rejecting the twist-on wire connector, said further rejection station removing the faulty twist-on wire connector from the assembly line if the further image output signal is outside a further acceptable range, said conveyor carrying the twist-on wire connector to a next station if the further image output signal is within the further acceptable range.

5. The system of claim 4 wherein each of the rejection stations is located after an image station.

6. A method for the manufacture of a twist-on wire connector containing a sealant comprising:

inserting a coil in a twist-on wire connector located on an assembly line to form a coil containing twist-on wire connector;

using an image sensor to generate a first image output signal of the coil containing twist-on wire connector on the assembly line;

comparing a reference output signal to the first image output signal of the coil containing twist-on wire connector to determine if the first image output signal of the coil containing twist-on wire connector on the assembly line is within an acceptable range;

identifying the coil containing twist-on wire connector on the assembly line if the first image output signal is outside the acceptable range and accepting the coil containing twist-on wire connector on the assembly line if the image output is within the acceptable range;

injecting a sealant into the coil containing twist-on wire connector on the assembly line to form a sealant containing twist-on wire connector;

using an image sensor to generate a sealant image output signal of the sealant containing twist-on wire connector on the assembly line;

comparing the sealant image output signal to a sealant reference output signal; and identifying the sealant containing twist-on wire connector on the assembly line if the sealant image output signal is outside an acceptable sealant range and accepting the twist-on wire connector on the assembly line if the sealant image output signal is within the acceptable sealant range.

7. The method of claim 6 including conveying twist-on wire connectors in an upright condition.

8. The method of claim 6 including the step of removing a faulty twist-on wire connector.

9. The method of claim 6 including the step of placing an end cap on the twist-on wire connector.

10. The method of claim 9 including the step of placing the sealant in the twist-on wire connector.

11. The method of claim 6 wherein comparing the sealant image output signal to the sealant reference output signal includes viewing the twist on wire connector during intermittent starting and stopping the assembly line.

12. The method of claim 11 wherein viewing the twist-on wire connector comprises monitoring a color of the twist-on wire connector.

13. The method of claim 6 wherein comparing the sealant image output signal to the sealant reference output signal includes viewing the twist-on wire connector comprises viewing the coil in the twist-on wire connector which is supported by the assembly line.

14. The method of claim 13 wherein viewing the twist-on wire connector comprises viewing the sealant and the coil in the twist-on wire connector.

15. The method of claim 13 wherein viewing the twist-on wire connector comprises viewing the end cap on the twist-on wire connector.

16. The method of claim 6 including monitoring both a shape and a size of the twist-on wire connector while the twist-on wire connector is in the image sensor.

* * * * *